US010111533B2

(12) United States Patent
Spinks et al.

(10) Patent No.: US 10,111,533 B2
(45) Date of Patent: Oct. 30, 2018

(54) CONTINUOUS POCKETED SPRING UNIT AND METHOD OF MANUFACTURE

(75) Inventors: Simon Paul Spinks, Cawood (GB); David Clare, Barnsley (GB)

(73) Assignee: Harrison Spinks Beds Limited, Leeds, West Yorkshire (GB)

( * ) Notice: Subject to any disclaimer, the term of this patent is extended or adjusted under 35 U.S.C. 154(b) by 445 days.

(21) Appl. No.: 13/884,049

(22) PCT Filed: Nov. 8, 2011

(86) PCT No.: PCT/GB2011/052169

§ 371 (c)(1),
(2), (4) Date: Jun. 24, 2013

(87) PCT Pub. No.: WO2012/063059

PCT Pub. Date: May 18, 2012

(65) Prior Publication Data

US 2013/0269116 A1 Oct. 17, 2013

(30) Foreign Application Priority Data

Nov. 8, 2010 (GB) ..... 1018768.0

(51) Int. Cl.
*A47C 27/06* (2006.01)
*B68G 9/00* (2006.01)

(52) U.S. Cl.
CPC ..... *A47C 27/064* (2013.01); *B68G 9/00* (2013.01); *Y10T 29/49613* (2015.01)

(58) Field of Classification Search
CPC ..... A47C 7/347; A47C 3/04; A47C 3/043; A47C 3/0436; A47C 3/0438; A47C 27/063; A47C 27/064; A47C 27/065; A47C 27/068; A47C 27/07; B21F 3/12; B21F 27/16; B21F 33/04; B21F 35/00; B21F 35/02; B68G 9/00; B68G 2009/005
See application file for complete search history.

(56) References Cited

U.S. PATENT DOCUMENTS 2,276,002 A * 3/1942 Torok ..... 140/3 R
3,355,747 A * 12/1967 Norman ..... 5/252
4,439,977 A * 4/1984 Stumpf ..... A47C 27/064 156/200
5,127,635 A 7/1992 Long et al.
5,438,718 A * 8/1995 Kelly ..... A47C 27/001 29/91.1
5,669,093 A * 9/1997 Ogle et al. ..... 5/720
(Continued)

OTHER PUBLICATIONS

"Fold." Merriam-Webster.com. Merriam-Webster, n.d. Web. Jan. 29, 2018. (Year: 2018).*

(Continued)

*Primary Examiner* — Nicholas F Polito
(74) *Attorney, Agent, or Firm* — Gesmer Updegrove LLP

(57) ABSTRACT

A method of forming a pocketed spring unit (10), comprising a plurality of pocketed spring portions (22, 24, 26) arranged in a row, is described. The pocketed spring portions each comprise a portion of coil spring encased in a pocket (32, 34, 36), wherein the axis of the spring is substantially transverse to the row. The method comprises the steps of: forming a continuous coil spring, encasing the spring in a pocket and deforming the encased spring to form the pocketed spring portions.

15 Claims, 14 Drawing Sheets

(56) References Cited

U.S. PATENT DOCUMENTS

| | | | | |
|---|---|---|---|---|
| 5,885,407 | A | 3/1999 | Mossbeck | |
| 5,957,438 | A * | 9/1999 | Workman et al. | 267/90 |
| 6,036,181 | A * | 3/2000 | Workman | 267/90 |
| 6,173,464 | B1 * | 1/2001 | McCune et al. | 5/720 |
| 6,260,223 | B1 | 7/2001 | Mossbeck et al. | |
| 6,260,331 | B1 * | 7/2001 | Stumpf | B65B 9/073 53/114 |
| 6,684,608 | B2 * | 2/2004 | Gibbons | B68G 9/00 53/114 |
| 6,922,895 | B1 * | 8/2005 | Whitworth | B21F 33/04 29/33 F |
| 2004/0103618 | A1 * | 6/2004 | De Santis | B68G 9/00 53/438 |
| 2005/0257883 | A1 * | 11/2005 | Anagnostopoulos | A47C 27/063 156/290 |
| 2009/0266032 | A1 * | 10/2009 | Spinks et al. | 53/438 |

OTHER PUBLICATIONS

International Search Report and Written Opinion dated Jan. 16, 2012 in connection with International Application PCT/GB2011/052169, 6 pages.

International Preliminary Report on Patentability dated May 14, 2013 in connection with International Application PCT/GB2011/052169, 4 pages.

* cited by examiner

CONTINUOUS POCKETED SPRING UNIT AND METHOD OF MANUFACTURE

PRIORITY INFORMATION

The present invention is a U.S. National Stage filing under 35 U.S.C. 371(c) of International Application No. PCT/GB2011/052169 filed Nov. 8, 2011, that claims priority to United Kingdom Patent Application No. 1018768.0, filed on Nov. 8, 2010, all of which are incorporated herein by reference in their entireties.

The present invention relates to pocketed springs, and is concerned particularly with a method and apparatus for forming a continuous pocketed spring unit.

Mattresses in which the springs are encased in pockets of fabric are generally held to be more comfortable and luxurious than conventionally sprung mattresses. This is partly because discrete, independently acting pocketed springs are more able to conform to the shape of a person's body than a mesh of interconnected springs in which the springs are unable to deform without affecting their neighbours. Also, the presence of the fabric pocket between adjacent springs lessens the likelihood that the springs will rub together, which can generate an unwelcome level of noise in what is meant to be a quiet environment.

However, the process of placing the coils in individual pockets, joining the pockets together to form a row (referred to as a "pocketed spring unit" for the purpose of the present application), and then joining together the rows to form an array of pocketed springs, is very labour intensive. Accordingly, this type of mattress is generally more expensive than conventionally sprung mattresses, and the greater the number of pocketed, springs the greater is the cost.

Another problem with individually pocketed springs arises from a need for convolutions at the beginning and end of the spring to be 'tipped in'. That is, in order to prevent the end of the wire of the spring from protruding through the mattress or foam, over a period of time, through the top or bottom of the mattress, an extra turn of wire is added at each end. The extra turn is arranged to bend back over itself so that the end of the wire is directed back towards the other end of the spring. This tipping in process is time consuming and also requires an increased consumption of materials (i.e. increased length of wire to form each spring).

U.S. Pat. No. 5,127,635 describes a pocketed coil spring assembly in which a continuous coiled spring is bent to form a set of coil portions and then wrapped in a fabric envelope to form a pocketed spring unit. The units are then attached together to form an array for use in a mattress. Whilst this approach may be less labour intensive than traditional methods, the individual response of the pocketed springs is inhibited by combining several in a single pocket.

A further consideration for the modern manufacturer of coil sprung mattresses is how to make the mattresses more readily recyclable. Whilst the "soft" parts of a mattress, such as wool or down—but not foam—can often readily be recovered for recycling, the wire used in the coils is usually very difficult to remove from the mattress, and its recycling is often not cost effective.

It is an object of the present invention to attempt to overcome at least one of the above or other problems.

According to the present invention there is provided a spring unit and method of forming a spring unit as set forth in the appended claims. Other features of the invention will be apparent from the dependent claims, and the description which follows.

According to one aspect of the invention there is provided a method of forming a pocketed spring unit comprising a plurality of pocketed spring portions arranged in a row, the pocketed spring portions each comprising a portion of coil spring encased in a pocket, wherein the axis of the spring is substantially transverse to the row, wherein the method comprises the steps of: forming a continuous coil spring, encasing the spring in a pocket and deforming the encased spring to form the pocketed spring portions.

Preferably, the step of deforming the spring comprises pressing, pinching or gathering the pocket between adjacent turns of the spring and then folding the spring within the pocket, to form the pocketed spring portions.

The method preferably comprises alternately folding the spring within the pocket in opposed directions, in the manner of a folded fan.

In a preferred arrangement the method comprises joining together adjacent pocketed spring portions to cause them to maintain their deformed configuration.

The invention also includes a method of forming a pocketed spring array, the method comprising taking a plurality of coil springs, encasing each spring within its own pocket, arranging the encased springs to be substantially parallel and joining the pockets of adjacent springs, then substantially simultaneously deforming the encased springs to form plural sets of pocketed spring portions.

Preferably the method comprises pressing, pinching or gathering the pockets between adjacent turns of the springs and then folding the springs within the pockets, to form the pocketed spring portions. The pressing of the pockets may be effected by inserting a blade member between adjacent turns of several adjacent springs substantially simultaneously.

The invention also includes a pocketed spring unit comprising a substantially continuous coil encased in a substantially continuous pocket, the spring and pocket comprising a plurality of folds wherein the folds define a plurality of individual pocketed spring portions in a row, each comprising a length of spring within a length of pocket, the spring portions having axes extending substantially transverse to the row.

According to an exemplary embodiment, there is provided a spring unit having at least two juxtaposed spring portions, wherein each juxtaposed spring portion is substantially encased by a pocket portion, the spring portions being integral with each other spring portion and the pocket portion being integral with each other pocket portion.

In accordance with embodiments of the invention an advantageous spring unit is provided because tipping in is required in far fewer places and so less spring material is used. Furthermore the springs are able to be more easily separated from the other mattress materials at the end of the spring unit's life, since withdrawal of one end of the continuous coil will initiate withdrawal of all the coil portions connected to it.

Preferably the spring unit has three or more juxtaposed spring portions formed in a fan-folded or "concertina" arrangement. Thus, advantageously, the spring unit can be made to a length suitable for the given end use of the spring unit.

Preferably, the juxtaposed spring portions form a first line and the spring unit has at least a second line of juxtaposed spring portions arranged adjacent or side-by-side to the first line. Thus, advantageously, the spring unit includes a matrix of juxtaposed spring portions. Preferably, each line of juxtaposed spring portions is separate to the other. Here, each line of juxtaposed spring portions may be joined by a linking member so that each line of integral spring portions can be separated from the spring unit together.

Preferably one end of each of the spring portions is arranged in a common plane.

The other end of each spring portion may be arranged in a common second plane that is spaced from the first common plane.

Preferably at least one end of the unit is formed such that the spring portion is constrained within the pocket portion.

In a preferred arrangement each pocket portion restricts the expansion of each spring portion when the spring portion is compressed.

According to the exemplary embodiments there is provided a method of forming a spring unit, the method comprising forming an elongate spring having a single axis, the method comprising encasing the elongate spring within a pocket to form a pocketed spring assembly. The spring assembly is folded along at least one lateral fold line that extends across the elongate axis of the elongate spring so that a spring unit is formed having at least two juxtaposed spring portions, wherein each juxtaposed spring portion is substantially encased by a pocket portion. The spring portions are integral with each other spring portion and the pocket portion are integral with each other pocket portion.

Preferably the method comprises, prior to folding the spring assembly, gathering a portion of one side of the pocket so that, when folded, the gathered portion extends across an end of each of two juxtaposed spring portions.

Preferably the method comprises sandwiching the formed elongate spring between a first and second web and joining the webs along at least one elongate fold line in order to form the pocket.

Preferably the method comprises folding the elongate spring along at least two lateral fold lines to form at least three juxtaposed, spring portions, the elongate spring being folded in a concertina fashion.

The method may comprise folding two or more elongate springs that are arranged side-by-side.

Prior to folding, the method may require the spring to be inserted in a pocket that is longer than the spring.

According to a further exemplary embodiment, there is provided a forming apparatus for forming a spring unit in accordance with a previous aspect. The forming apparatus comprises a coiling station, a gathering station, and a folding station. The coiling station may include at least one coiler for producing a single, elongate spring. The gathering station may include means to encase the single elongate spring in an elongate pocket to form a spring assembly. The gathering station also may include gathering means to gather portions of the pocket in order to cause an amount of the pocket on alternate sides of the pocket to have a greater density as compared to a side of the pocket immediately opposite. The folding station may include means to fold the spring assembly along at least one lateral fold line to form at least two juxtaposed spring portions, wherein each juxtaposed spring portion is substantially encased by a pocket portion. The spring portions are integral with each other spring portion and the pocket portions are integral to each other pocket portion.

The coiling station, gathering station and the folding station may be used individually or in a combination.

Consequently, according to a further exemplary embodiment, there is provided a gathering station that includes means to encase a single elongate spring in an elongate pocket to form a spring assembly. The gathering station also includes gathering means to gather portions of the pocket in order to cause an amount of the pocket on alternate sides of the pocket to have a greater density as compared to a side of the pocket immediately opposite.

Preferably, the gathering station includes unwinding means to unwind at least a first web wherein the spring is arranged to be sandwiched by web material and fed through a joining means and gathering means.

Preferably the joining means joins two parts of the web material along at least one elongate line in order to encase the elongate spring.

Preferably, the gathering means includes pushers. The pushers being arranged to move toward and away from each elongate spring. The pushers penetrating between adjacent convolutions of the spring as they move toward the spring in order to force web material between said convolutions.

Furthermore, according to a further exemplary embodiment, there is provided a folding station that includes means to fold the spring assembly along at least one lateral fold line to form at least two juxtaposed spring portions, wherein each juxtaposed spring portion is substantially encased by a pocket portion. The spring portions are integral to each other spring portion and the pocket portions are integral to each other pocket portion.

Preferably, the folding station has a first openable compartment. The first openable compartment is arranged to be able to close around a first portion of the spring assembly. Here, the folding station includes a second openable compartment that is arranged to be able to close around a second portion of the spring assembly that is adjacent to the first portion. The folding station includes means to pivot the first compartment relative to the second compartment, the compartments being rotated about a lateral fold line.

Preferably, the folding station includes three or more openable compartments. Each openable compartment is arranged to be able to close around adjacent portions of the spring assembly. The folding station includes means to pivot adjacent compartments relative to each other in a concertina fashion.

Preferably each openable compartment is formed from a first section and a second section, wherein adjacent first sections of each compartment are pivotally linked to each other and adjacent second sections of each compartment are pivotally linked to each other.

Preferably each compartment is arranged to enclose a respective spring portion by moving opposed pivots between first sections and second sections towards each other, wherein the pivots between adjacent compartments are formed by pairs of pivots.

Preferably, the means to cause the compartments to pivot relative to each other comprises means to control the position of the pivots relative to each other. Preferably, the position of the pivots between each compartment is controlled by constraining the pivots to move along a desired path. Every other pivot is constrained to move along a different path to the intermediate pivots. Here, preferably, the folding station includes means to drive the pivots along the paths.

The invention also includes a forming apparatus having a folding station according to any statement herein, wherein the forming station also includes a gathering station, wherein the gathering station includes means to encase the single elongate spring in an elongate pocket to form a spring assembly, the gathering station also including gathering means to gather portions of the pocket in order to cause an amount of the pocket on alternate sides of the pocket to have a greater length as compared to a side of the pocket immediately opposite.

The forming station may also include a coiling station having at least one coiler for producing a single, elongate spring.

The invention also includes a method of forming a spring unit comprising closing a first openable compartment about a first portion of a spring unit, and closing a second openable compartment about a second portion of the spring unit, the second portion being sequential to the first, and wherein the method comprises causing the first compartment to pivot relative to the second in order to form a spring unit having at least two juxtaposed spring portions with each spring portion being integral with each other spring portion and that are substantially encased by pocket portions with pocket portion being integral with each other pocket portion.

The method may comprise opening the first and second compartments to release the spring unit.

Preferably the method comprises closing three or more compartments about sequential portions of the spring unit and causing the compartments to pivot in a concertina fashion.

The method may comprise using a pusher of a gathering station to gather portions of the pocket in order to cause an amount of the pocket on alternate sides of the pocket to have a greater length as compared to a side of the pocket immediately opposite.

According to a further exemplary embodiment there is provided a method of forming a spring unit comprising using a forming apparatus of the previous embodiments.

Preferably, the method comprises using a folding station, the method comprising closing a first openable compartment about a first portion of a spring unit, and closing a second openable compartment about a second portion of the spring unit, the second portion being sequential to the first. The method comprises causing the first compartment to pivot relative to the second in order to form a spring unit having at least two juxtaposed spring portions that are integral to each other spring portion and that are substantially encased by pocket portions that are integral to each other pocket portion. The method further comprises opening the first and second compartments to release the spring unit.

Preferably the method comprises repeating the process for each sequential portion of the spring unit in a concertina fashion.

Preferably the method comprises, prior to using the folding station using a gathering station.

The invention may include any combination of the features or limitations referred to herein, except such a combination in which the features are mutually exclusive.

For a better understanding of the invention, and to show how embodiments of the same may be carried into effect, reference will now be made, by way of example, to the accompanying diagrammatic drawings in which.

In an exemplary embodiment, a method of forming a pocketed spring unit begins by forming an elongate spring having a single axis. The elongate spring having a single axis is then encased within a pocket to form a pocketed spring assembly. The pocketed spring assembly is then folded along at least one lateral fold line that extends across the elongate axis such that one portion of the pocketed spring assembly is folded back on itself so that two spaced locations on one side of the pocket are arranged to lie substantially face-to-face. Consequently, a spring unit is formed having a spring with two or more substantially parallel axes. Thus two or more juxtaposed spring portions that are substantially encased within discrete individual pocket portions are formed, wherein the two or more spring portions remain integral. Consequently an improved spring unit is formed. This is because the number of ends of wire needed to form the spring unit is reduced. For instance, a spring unit having two juxtaposed springs has two ends rather than four as would be the case if the springs were separate. This means that fewer turning in operations are required. Also, less wire is consumed because the additional convolution required for the turning in operation is not required as often. It will be appreciated that the number of lateral folds, and therefore the number of juxtaposed springs, is dependent on the size of the elongate spring and the size of the required spring unit. It will also be appreciated that the more folds and therefore the more juxtaposed springs there are, the greater is the saving. For instance, a spring unit having nine folds and therefore ten juxtaposed springs, still only has two ends. If the springs were formed separately, a total of twenty ends would be required. Two or more spring units may be secured together to form a spring unit assembly for use in forming a mattress.

Figure 1:
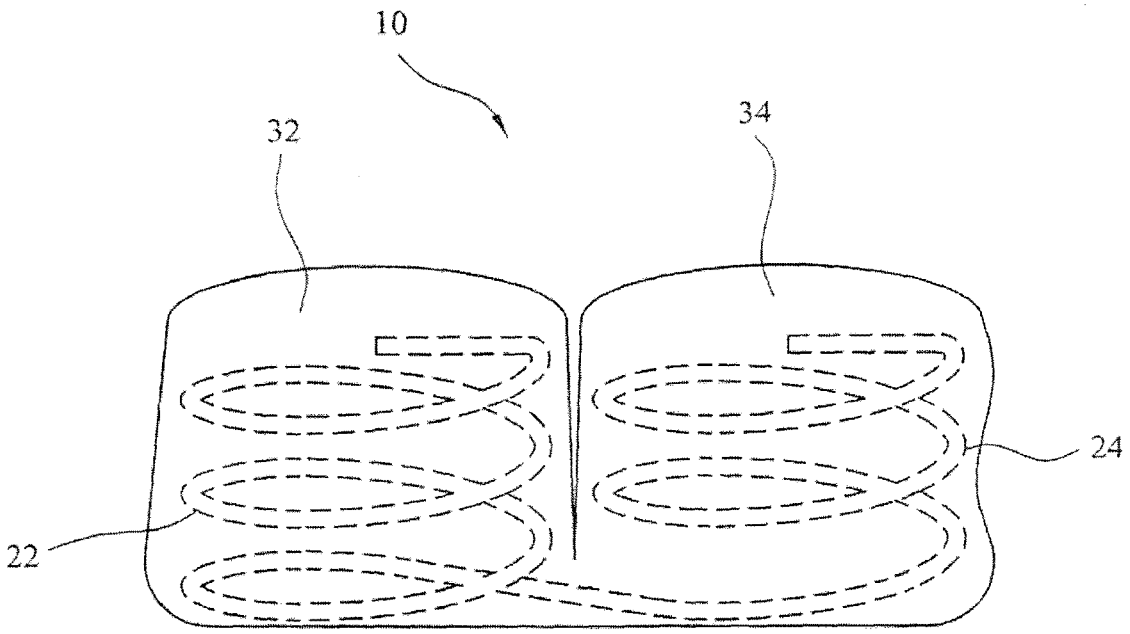
FIG. 1 is a front perspective view of a spring unit according to a first embodiment.

Referring to FIG. 1, the method therefore produces an exemplary spring unit 10 for use in forming a mattress suitable for beds, divan beds, pillows and other articles such as upholstered furniture, seats, cushions and resilient panels. The spring unit 10 has two juxtaposed spring portions 22, 24 wherein each juxtaposed spring portion 22, 24 is substantially encased by a pocket portion 32, 34. The spring portions 22, 24 are integral as are the pocket portions 32, 34. Because the spring portions 22, 24 are integral (i.e. formed from a single piece of wire) fewer turning in operations are required as explained above. Also, the spring unit is improved as, when the mattress is discarded, the spring wire can be withdrawn from the mattress by pulling a single end of the wire. This enables the wire to be recycled and/or the remaining mattress materials to be more easily discarded/re-used.

A particularly suitable spring unit and method of forming is illustrated with reference to FIGS. 2 to 5.

Figure 2:
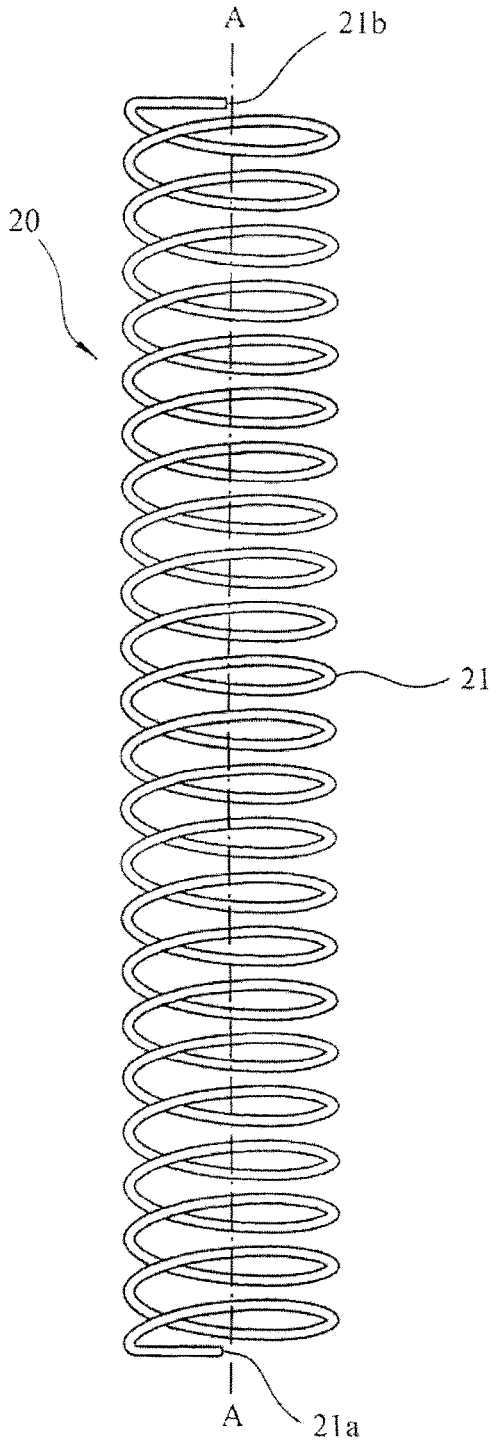
FIG. 2 is a top perspective view of an elongate spring.

Referring to FIG. 2, a single, elongate spring 20 is first formed. The spring 20 has a single axis A-A. The spring 20 is suitably a helical compression spring formed from a length of spring wire 21. The spring 20 therefore has ends 21*a* and 21*b*. Each end 21*a*, 21*b* is turned down in the known manner, whereby an additional convolution is used.

Figure 3:
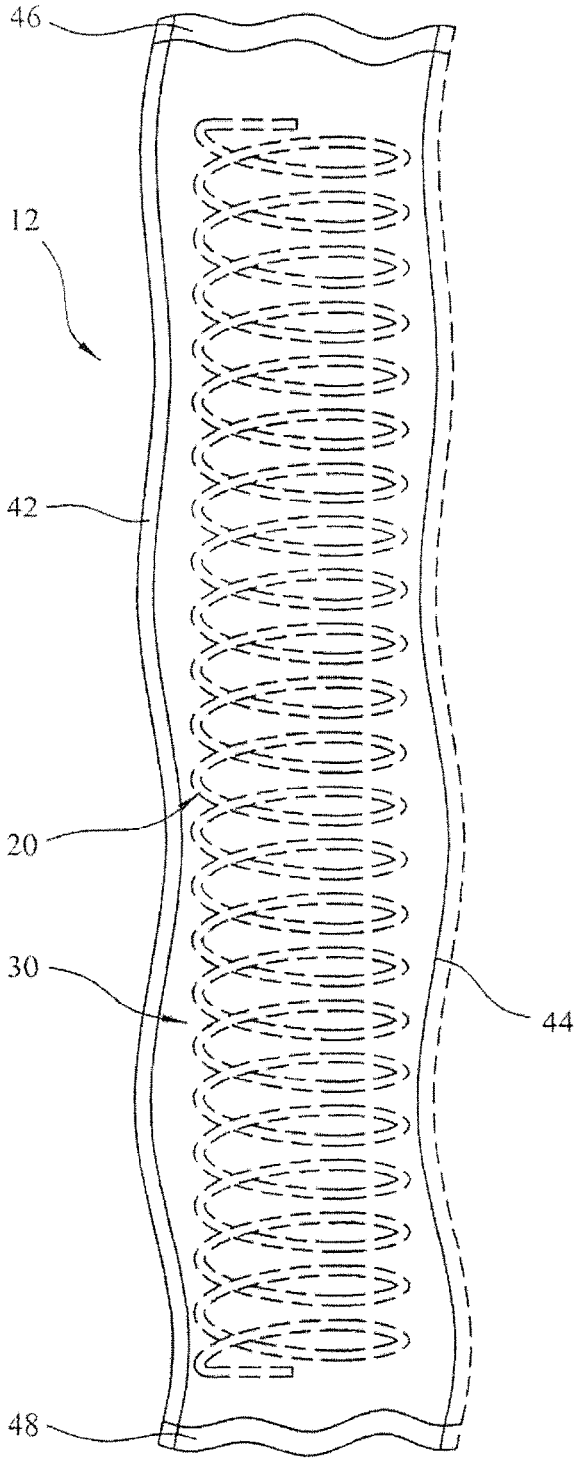
FIG. 3 is a top perspective view of the elongate spring of FIG. 2 encased in an elongate pocket to form a spring assembly for use in forming a spring unit according to a second embodiment.

As shown in FIG. 3, the single elongate spring 20 is encased in a single elongate pocket 30 to form a pocketed spring assembly 12. As herein described, in order to account for the gathering of the pocket 30 as the spring assembly 12 is formed into a spring unit 10, the pocket 30 is formed longer than the spring 20. The spring 20 may be encased in the pocket 30 by any suitable method. However, a particularly suitable method is to sandwich the spring 20 between a first web and a second web and subsequently forming a seal between the webs. A single seal may be formed shown by seal 42 in FIG. 3. In this case, the first and second webs are formed from a single sheet folded along the sheet's elongate axis. Alternatively, the first and second webs may be separate. Here a second, spaced and parallel join would also be formed as indicated by the dotted seal 44 in FIG. 3. Optional end joints 46, 48 may also be formed in order to keep the ends of the spring assembly 12 tidy.

Figure 4:
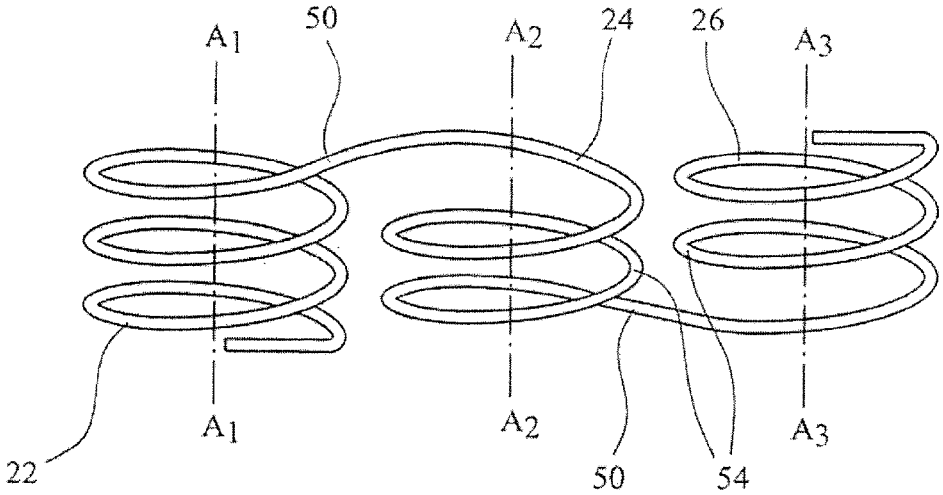
FIGS. 4 and 5 are side perspective views of a spring unit of the second embodiment, wherein in FIG. 4, the pocket is shown removed.
Figure 5:
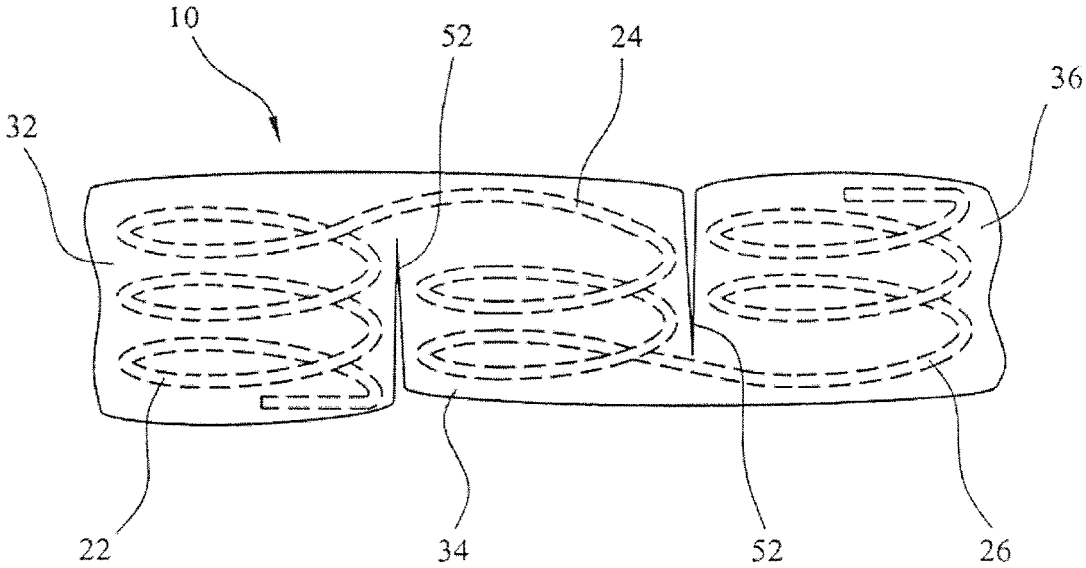

Referring to FIGS. 4 and 5, the spring assembly 12 is formed in to a spring unit 10 having two or more spring portions having discrete, parallel axis $A_1$, $A_2$, $A_3$, by folding the spring assembly 12 to form three juxtaposed spring portions 22, 24 and 26. Each spring portion is integral with the other. Each spring portion is encased by a discrete pocket portion 32, 34, 36, which are also integral. Suitably, the spring unit 10 is formed by fan-folding the spring assembly 12 at two spaced, lateral locations. In this case, and referring to FIG. 4, two joining portions of spring wire are formed as generally indicated at 50. Although with a round spring wire, it may not be visible, the joining portion is in effect caused to be twisted such that, when viewed from a plan view, the joining portion and the adjoining convolutions of the spring portions form an "S" shape. Consequently, juxtaposed spring portions convolute from one end to the other in alternate directions.

Referring to FIG. 5, the pocket 30 is shown as being gathered at areas 52. That is, in order to maintain the benefit of each spring portion being substantially encased within a discrete, juxtaposed pocket portion, the pocket at 52 must extend substantially between the juxtaposed spring portions. The gathering effect requires the pocket 30 to be longer than the spring 20. Preferably the pocket extends past the last full convolution of each juxtaposed spring portion (i.e. as indicated by numeral 54 in FIG. 4).

It will be appreciated that the number of convolutions of each spring portion will be determined by the requirements of the finished mattress. Also, the mattress area required may be achieved by forming the elongate spring longer and introducing further bends. Additionally, more than one spring unit 10 may be secured together in order to form the required area. Here, the spring units 10 may be secured in end-to-end or side-by-side relationship or a combination thereof.

Where required the pocket portions of each pocket may be secured together.

Consequently, there is provided a method of forming a spring unit and a spring unit having a plurality of spring portions, each having a discrete, separate axis that is substantially spaced from, and parallel to, the others, but that remains encased substantially within a discrete pocket portion. However, because two or more spring portions are integrally formed from a single length of spring wire, the amount of spring wire can be reduced. Also, the number of turning in operations is reduced. When the article reaches the end of its useful life each spring wire can also be drawn from the finished mattress in order to separate the spring wire from the rest of the mattress material, for example for recycling. Where two or more spring wires are used in a spring unit, the spring wires can be joined so that they can be removed in a single operation.

The spring units 10 have so far been described in relation to a single spring to produce juxtaposed spring units in a lateral direction. It is preferable, however, if two or more elongate springs are pocketed so that the spring assembly 12 comprises two or more parallel but individually encased springs. Whilst the number of springs can be set according to the required size of the spring unit, it is preferable if each spring unit is formed with five springs. This is because, with a standard 30 mm diameter spring, five springs can form a unit 150 mm (approximately six inches) wide and this corresponds to a common unit into which all current standard mattress sizes can be divided. However, as explained herein, a preferable forming apparatus simultaneously coils each spring. Here, five spring coils have been found to be a good balance. If there are fewer springs the efficiency is reduced. If there are more springs the risk of a coiler breaking or requiring maintenance, and therefore taking the whole apparatus off-line, is increased.

A preferable five spring unit is described with reference to FIGS. 6 to 10.

Figure 6:
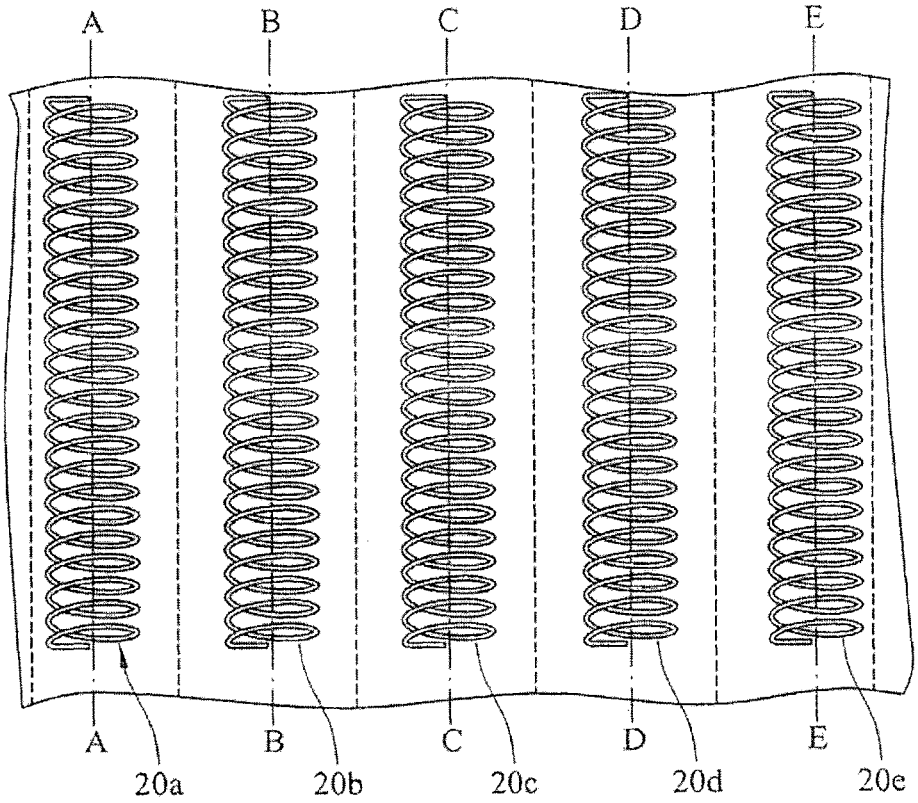
FIG. 6 is a plan view of an assembly stage of a spring assembly for use in forming a spring unit according to a third embodiment.
Figure 7:
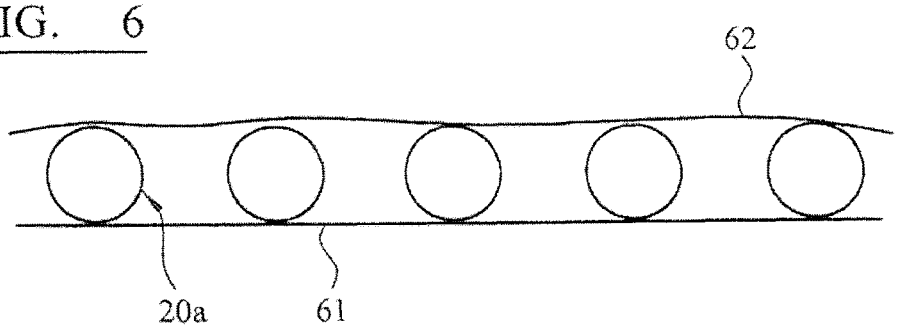
FIGS. 7 and 8 are end views of a spring assembly shown in pre-formed and formed arrangements respectively.

Referring to FIGS. 6 and 7 a plurality of springs 20*a*-20*e* (shown here as five) are arranged adjacent and parallel to each other. Thus each spring has a spaced and parallel axis A, B, C, D, E respectively. Ideally the adjacent springs are coiled in alternately opposed directions, such that from e.g. left to right a left handed spring is followed by a right handed spring which is followed by another left handed spring and so on. Alternating the handedness of the springs in this way cancels out any tendency for the axis of the springs to become twisted in one direction due to the direction in which the springs are coiled. The springs are located between first and second webs 61, 62. As shown in FIG. 7, suitably the first and second webs are upper and lower webs. The webs may be sheets or layers of fabric or other suitable material. The first and second webs may be formed separately or may be formed from a single folded sheet as previously described.

Figure 8:
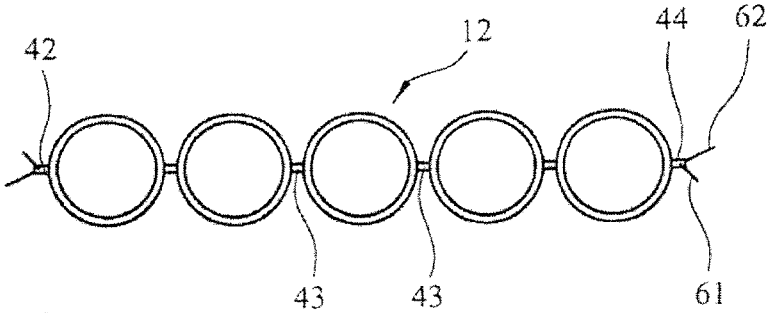

Referring to FIG. 8, a spring assembly 12 is formed by joining the first and second webs 61, 62 so as to encase each spring 20. This is achieved by forming elongate joins 43 between each spring and optional side joins 44 if the webs are separate. The joins may be continuous or intermittent. Depending on the material used, the joining method may be welding, ultrasonic welding, adhesive, stitching or other means. As previously discussed, end joins may be formed to completely encase each spring.

Figure 9:
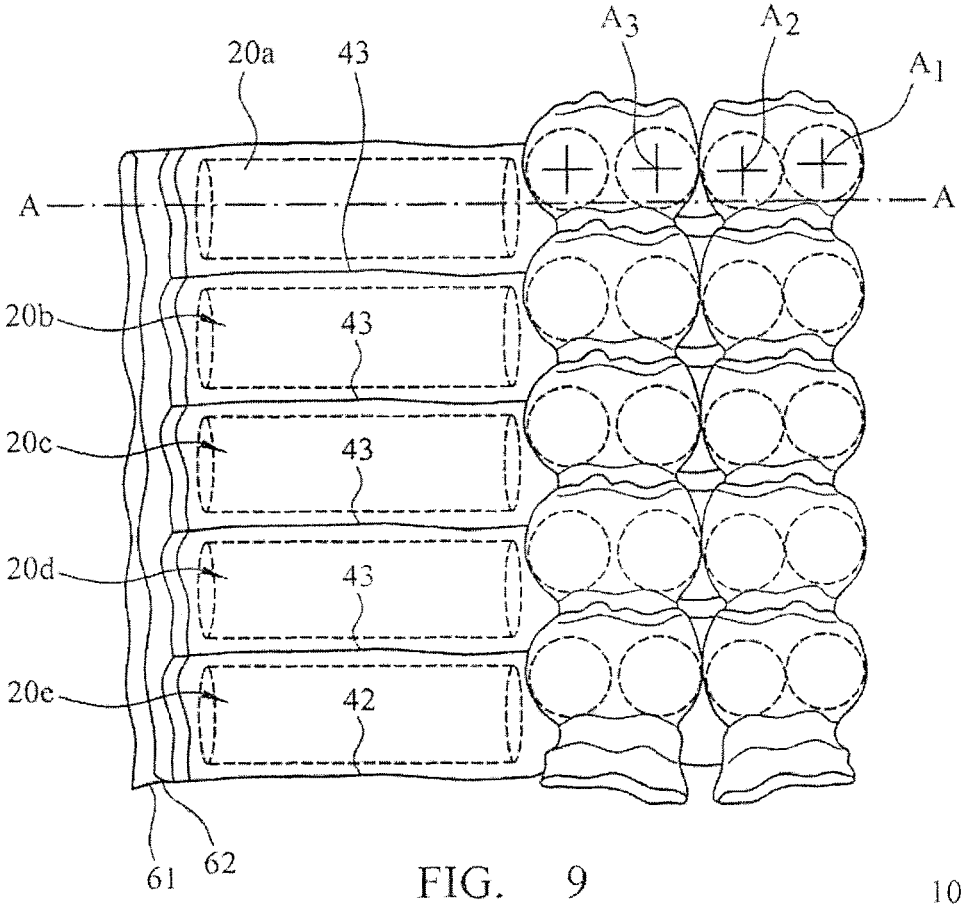
FIG. 9 is a plan view of a partly formed spring unit according to the third embodiment.
Figure 10:
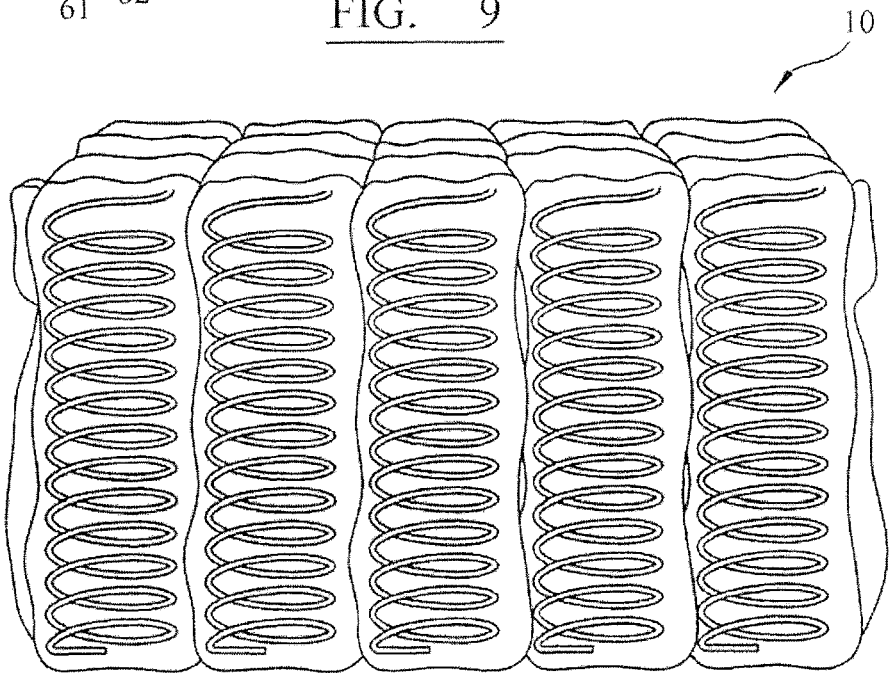
FIG. 10 is an end perspective view of a formed spring unit according to the third embodiment.

The spring assembly 12 is folded to form a spring unit 10 as shown in FIG. 9. Here, each spring 20 is fan folded from one end so that a plurality of juxtaposed spring portions is formed. The spring portions have respectively spaced and parallel axes $A_3$, $A_2$, $A_1$. Thus, whilst each spring remains a single spring, it has been bent or otherwise deformed such that it has a plurality of axes. When viewed from a plan view (as shown in FIG. 9), the top of two juxtaposed spring portions are covered by a single layer of the pocket and the next juxtaposed spring portion separated by a double piece of the same single layer, the double piece being folded back on itself. The double pieces may be secured together in order to maintain the form of the spring unit. For instance a stitch may be used. Alternatively, a flat sheet may be secured to one side. As shown in FIG. 10, it is preferable if both the top and bottom convolution of each spring portion are arranged on common planes.

Figure 11:
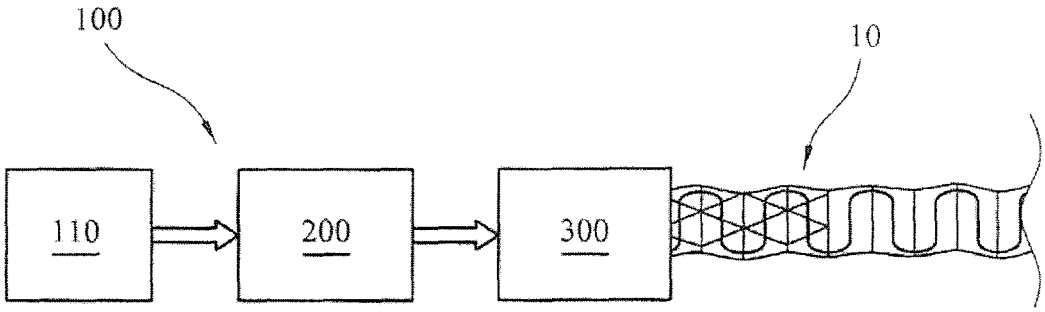
FIG. 11 is a pictorial view of a forming apparatus for use in forming a spring unit.
Figure 12:
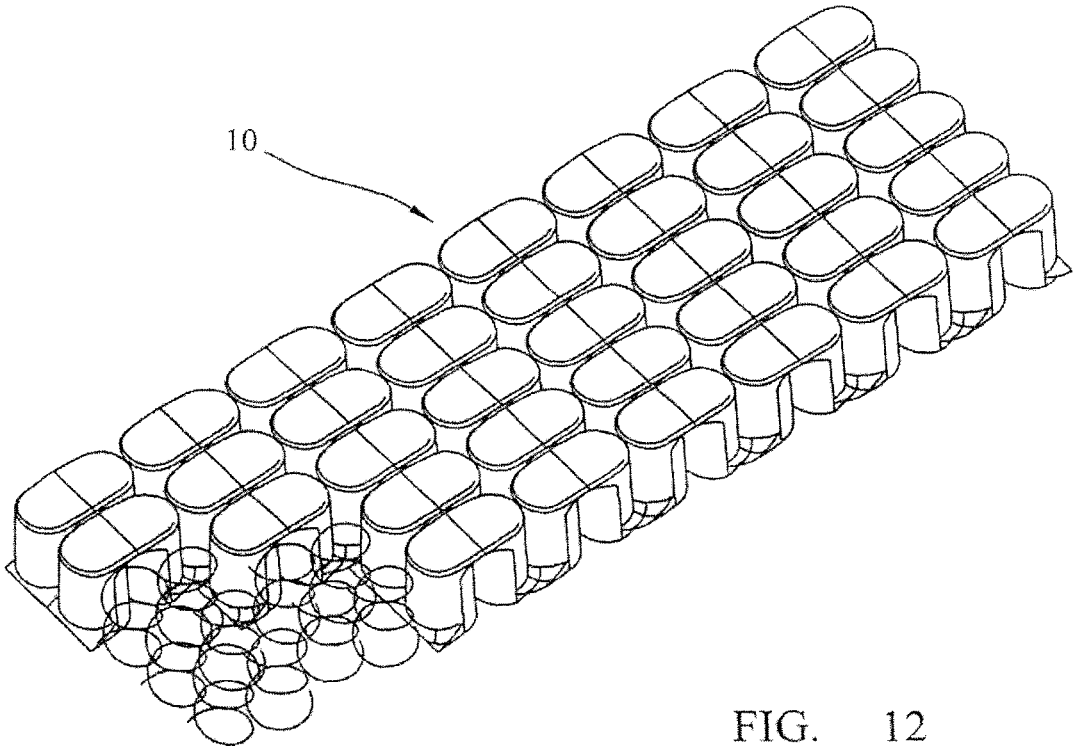
FIG. 12 is a perspective view of the formed spring unit of FIG. 11.

Referring to FIG. 11, an exemplary embodiment of a forming apparatus 100 is described. The forming apparatus 100 comprises a coiling station 110, a gathering station 200 and a folding station 300 in order to produce a spring unit 10. The coiling station 110 comprises at least one coiler. Each coiler produces a single, elongate spring. The single, elongate spring is fed into the gathering station 200. The gathering station encases the single, elongate spring in a single elongate pocket by joining a first and second web to each other about each elongate length of the single, elongate spring to form a spring assembly as previously described. The gathering station also includes gathering means to gather portions of the pocket. Here, the gathering means causes an amount of the pocket on alternate sides of the pocket at equally spaced locations to be pressed, or gathered, as compared with a side of the pocket immediately opposite to the gathered portion. Preferably, the pocket is gathered by forcing one side of the pocket between adjacent convolutions of the spring. The spring assembly is fed to the folding station. The folding station 300 causes the spring assembly to be folded at at least one, and preferably a plurality, of lateral fold lines. Suitably, the folding station has a first openable compartment. The first openable compartment is caused to close around a first portion of the spring assembly. Here, the folding station includes a second compartment that is arranged to close around a second portion of the spring assembly that is immediately adjacent to the first portion. The folding station has means to pivot the first compartment relative to the second compartment, the compartments being rotated about a lateral fold line. Consequently, a fan folded spring unit 10, as previously described, is formed. To form a spring unit having more than one lateral fold line, the process is repeated by forming a compartment about a third and subsequent portions of the spring assembly, where the third and subsequent portions are immediately adjacent the previous portion. The folding station has means to pivot each adjacent compartment relative to the other and in alternate directions. Thus, as shown in FIG. 12, the spring assembly is folded to form a spring unit 10 having a plurality of discrete, spaced and parallel axes, with each spring portion individually encased.

In a particularly suitable embodiment five coiled springs are processed at a time. Though a machine could be built to process any number of springs, five has been chosen in this case as this produces a 6" wide array of springs which is a sub-division of all the widths of mattress from 3' upwards, with the intended finished length being equal to the length of the mattress being produced. An exemplary five spring forming apparatus will now be described.

A five spring coiler 110 may comprise five known single spring coilers arranged in an adjacent arrangement in order to produce five spaced, parallel springs.

Figure 13:
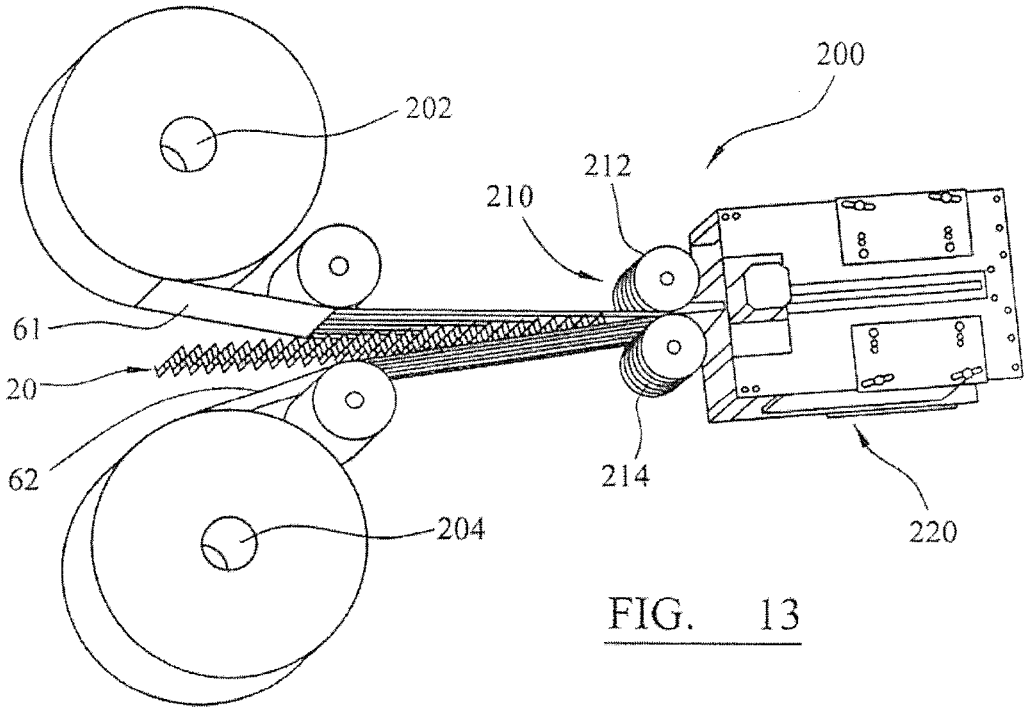
FIG. 13 is a perspective rear view of a gathering station from an underside.

A particularly suitable five spring gathering station 200 is shown with reference to FIGS. 13 to 17. Referring firstly to FIG. 13, the gathering station 200 has first and second un-winding bobbins 202, 204 for unwinding first 61 and second 62 webs of material to form a pocket. The bobbins 202, 204 are arranged either side (upper and lower in FIG. 13) of the formed springs 20. The springs and webs are fed through a joining means 210 and a gathering means 220 of the gathering station.

The joining means 210 is arranged to form joins 42, 43 and 44 (where appropriate). As previously described, the joins secure the first and second webs either side of each elongate spring. The joins may be continuous or periodic and may be formed in any suitable manner. However, as shown in FIG. 13, the joining means is shown as first and second welding rollers 212, 214. Suitably, the welding rollers are arranged either side of a plurality of chutes 216 (shown in FIG. 14). The chutes 216 allow the elongate springs to pass there-through and provide a former for the upper and lower webs. Thus the upper and lower webs are encouraged to form a cylindrical shape. The welding rollers compress the two webs together at gaps between each chute and form the join. It is preferable if the thickness of the join is kept to a minimum. Also, suitably the upper and lower webs form a cylindrical shape having a similar diameter to that of the spring so that the pocket is formed tightly around the spring.

Figure 14:
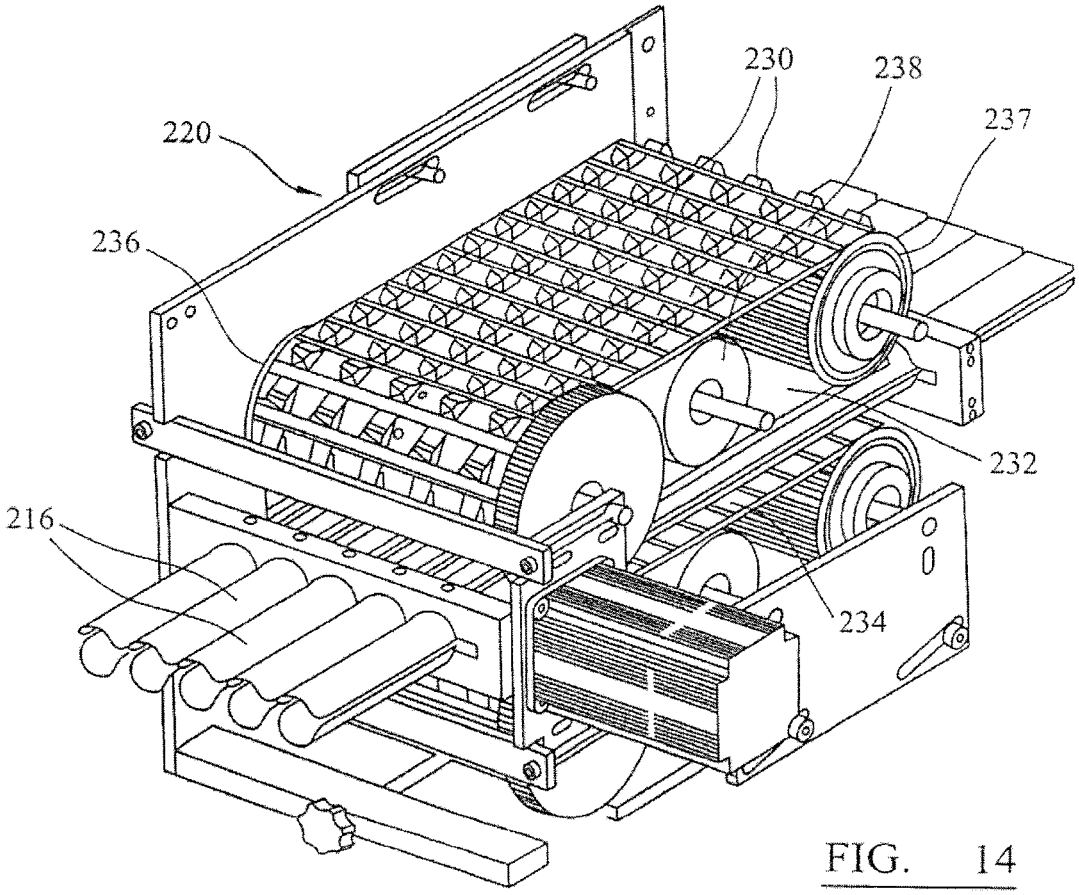
FIG. 14 is a perspective rear view of a gathering means of FIG. 13.

The gathering means 220 gathers one side of the web along spaced, lateral fold lines and gathers the other side of the web at equally spaced, but offset, lateral fold lines. The gathering is important as it is necessary to provide for the increased material needed to form the outside of a bend as opposed to the inside. Preferably, the gathering means presses or pushes some of the web material between adjacent convolutions of the spring. In the exemplary embodiment shown in FIG. 14, the gathering means 220 includes pushers 230 arranged on opposed sides of springs. The pushers 230 are arranged to move towards and away from the springs. Consequently, in use, the pushers 230 are caused to be inserted between convolutions of the spring. As they are inserted, the pushers cause material to be pushed between the convolutions. The chutes 216 extend through the gathering means in order to support the springs. Here the pushers act through an aperture in opposed sides of the chutes. Preferably, the gathering means includes a plurality of pushers. Suitably, as shown, each pusher is substantially wedge-shaped. Here, it is preferable if the pushers are also rotated as they are moved towards and away from the spring. This is advantageous as it aids the opening of the convolutions which helps force the web there-between. Consequently, as shown in FIG. 14, in the exemplary embodiment, the pushers are formed on first 232 and second 234 movement means, suitably shown as top and bottom continuous belts. The pushers are arranged in lateral lines across each belt. The lateral lines are spaced according to the pitch of the required folds. It will be appreciated that the top and bottom pushers are offset so that the pushers on one belt are arranged opposite a mid point between pushers on the other belt. Each lateral line of pushers is shown as also being formed from a plurality of discrete pushers so as to allow the chutes to provide increased support to the springs.

Figure 15:
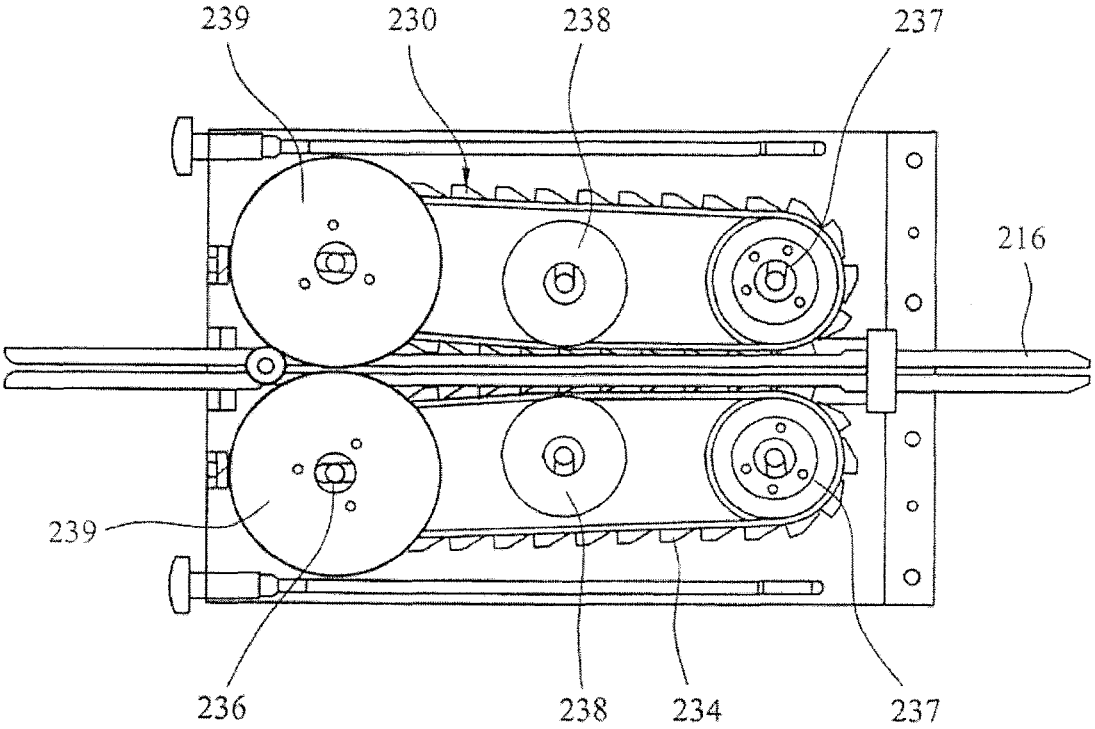
FIG. 15 is a perspective rear view of a gathering means of FIG. 14.

In the exemplary embodiment shown in the Figures, the continuous belts 232, 234 are supported by rollers. Each continuous belt includes a driven roller 236, an idler roller 237 and a support roller 238. The driven rollers 236 of each belt are controlled to drive each belt at the same speed. Thus, as can be seen in FIG. 15, it is preferable if the driven rollers 236 of the first and second belts are driven together by gears 239. One of the gears 239 can then be driven in any known manner in order to drive the belts. Because the pushers engage the spring, the belt also drives the springs through the gathering machine.

It will be appreciated that because the additional length of material needed to pass across the outside of each fold depends in part on the amount of pre-load (initial firmness) that is required in the finished spring unit, different amounts of material need to be gathered for different spring units. It is therefore preferable if the degree of insertion of each pusher 230 within the spring is controllable. This is because the degree of insertion determines the amount of material gathered.

Figure 16:
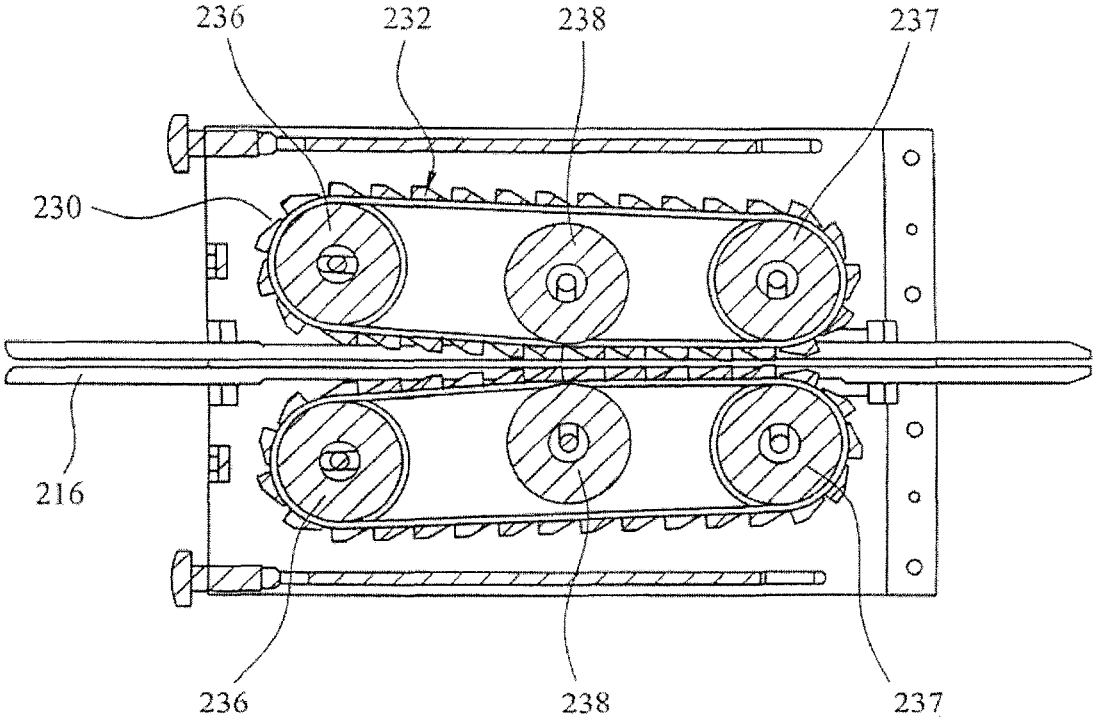
FIG. 16 is a cross-sectional side view of the gathering means of FIG. 14.
Figure 17:
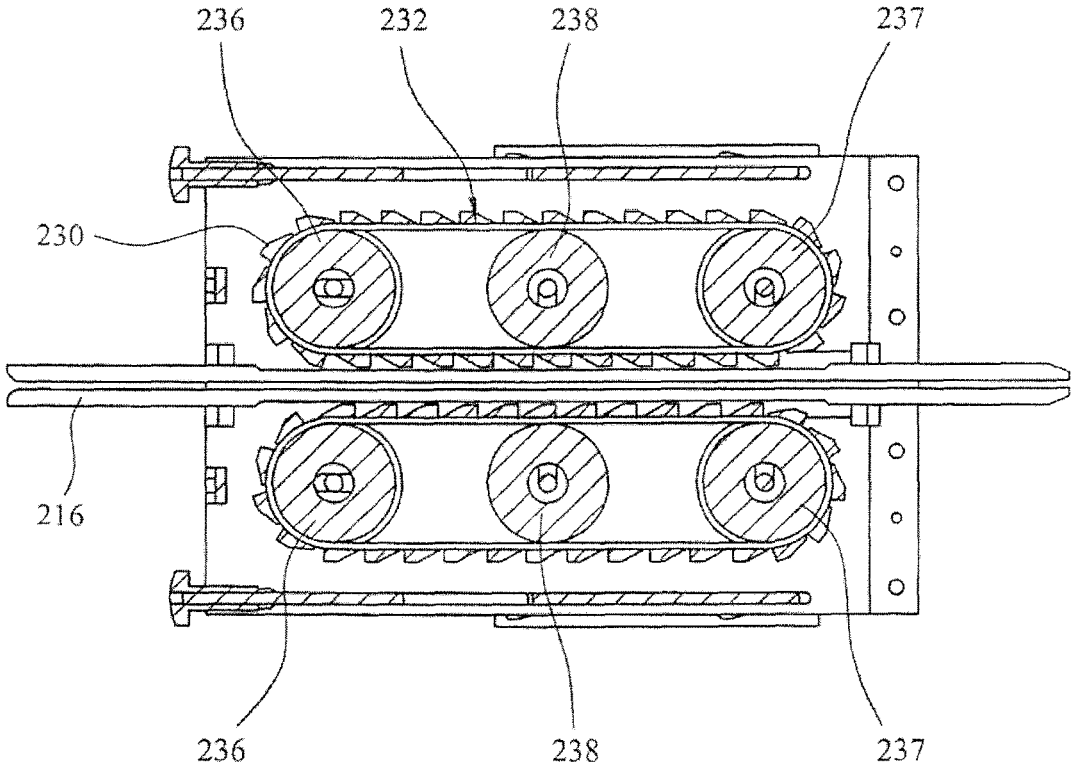
FIGS. 17 and 18 are cross-sectional side views of the gathering means of FIG. 14 in a first and second arrangement.

Thus, in the exemplary embodiment, the idler rollers 237 and support rollers 238 are moveably mounted. The rollers 237, 238 may be movably mounted in any suitable manner. For instance, they may be mounted to a support frame that is moveably mounted. It is preferable for the top and bottom rollers to move towards and away from the spring by the same degree. Thus the movement of the upper and lower rollers may be controlled separately or in common. FIG. 16 shows the rollers arranged in a first arrangement wherein the rollers 237, 238 are spaced towards each other so that the pushers 230 project to a greater degree into the springs. FIG. 17 shows the rollers 237, 238 arranged in a second arrangement wherein they are spaced further apart such that the pushers project a lesser degree into the springs. The optional support roller 238 maintains a substantially parallel portion of the belts. Also, the rollers at the entrance to the belts (driven roller 236 in the exemplary embodiment) are arranged to be spaced further apart than the other rollers, even in the second arrangement. This maintains a tapered section of belt at the entrance that helps ease the pushers into the springs.

In the exemplary embodiments, and as shown with reference to FIGS. 18-23, the folding station 300 includes a plurality of openable compartments 310. The openable compartments are arranged to close around sequential portions of the spring assembly in order to contain a desired number of convolutions in each compartment. Each openable compartment is pivotally linked to an adjacent compartment. The folding station further includes means 330 to cause the openable compartments to rotate relative to each other in a concertina fashion so that the spring assembly is folded as herein described.

Figure 18:
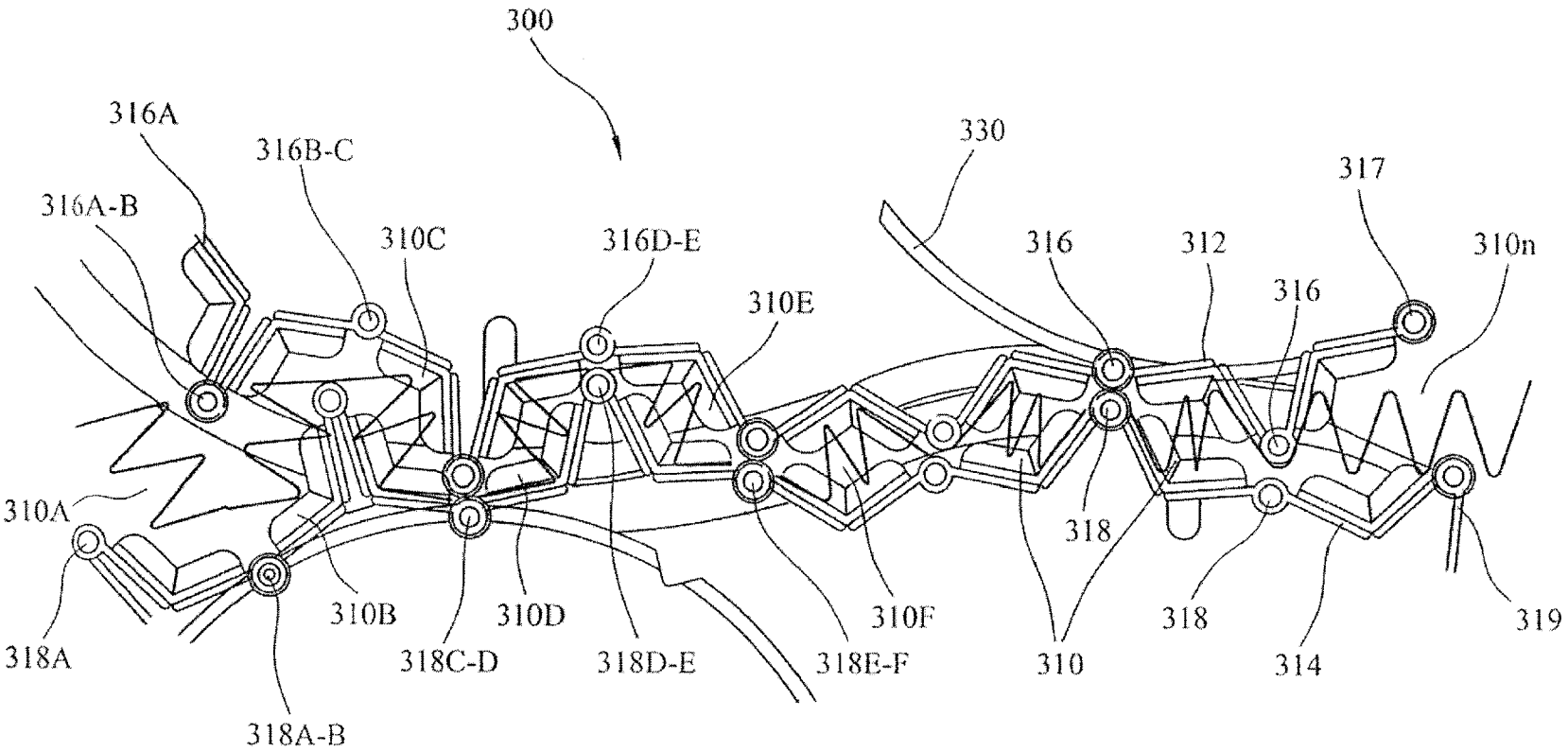

FIG. 18 shows an exemplary embodiment of the plurality of openable compartments 310. For illustration purposes the pocket of the spring assembly is not shown. Here, each compartment 310 is formed from two opposed sections 312, 314. A plurality of adjacent compartments 310A-310*n* are formed by joining the ends of each opposed section 312, 314 at hinges 316, 318 respectively. Thus a top track 317 and bottom track 319 are formed. A front end of first compartment 310 A is closed to trap the spring assembly between opposed hinges 316A, 318A in the upper and lower track respectively. Thus the opposed hinges make a front hinge pair. The first compartment is closed by subsequently closing a rear end of the first compartment 310 A by trapping a spaced part of the spring assembly with hinges 316A-B, 318A-B. These hinges make a rear hinge pair to compartment 310 A, but also a front hinge pair to compartment 310 B. The number of convolutions captured by each compartment determines the size (height) of the individual springs. However, the number of convolutions always ends in a half convolution when counted from the part of the spring trapped by the front hinge pair. Consequently, the front hinge pair of each compartment is brought together by one of the upper or lower hinges being inserted into the spring assembly and the rear hinge pair of the compartment being brought together by inserting the other of the upper or lower hinge into the spring assembly. It will be appreciated that, when used with a gathering station, the hinge inserted into the spring assembly inserts in between the folded (gathered) portion of the pocket. Compartments capture the entire length of the spring assembly. The compartments are folded by the means 330 to fold the spring assembly to form a spring unit 10 as previously described.

It is preferable that the compartments capture the spring sequentially such that the front end of the spring is being folded before the rear end has been captured. Thus the upper and lower tracks move from right to left (when viewing FIG. 18). This drives the spring assembly through the folding machine. Consequently, it is preferable that the upper and lower tracks are continuous. Also to aid the folding of the compartments, suitably the first 312 and second 314 sections of each component are flexible. As shown in the Figures, suitably the sections are formed from first and second pivoted links. Here the pivoted links are pivoted to each other at a mid position.

Figure 19:
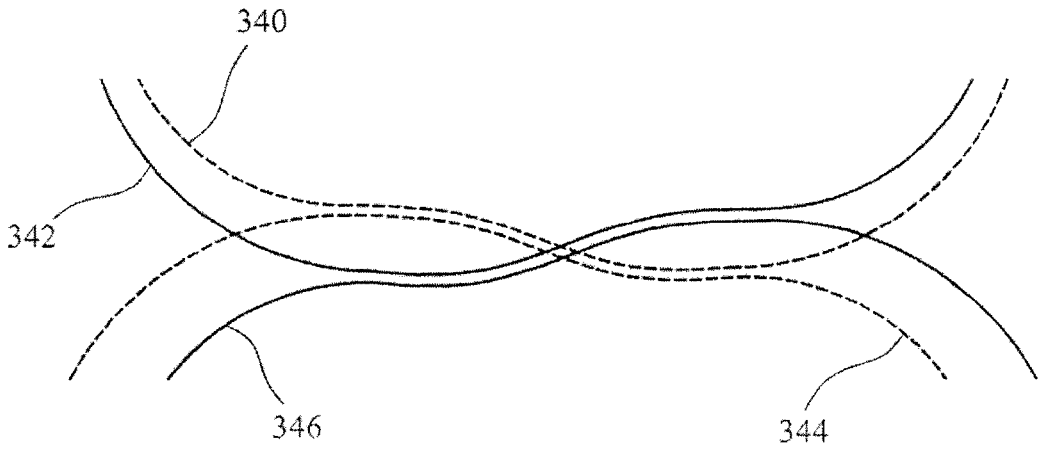
FIGS. 19 and 20 are pictorial views of alternative embodiments of a path controlling means of a folding station.

The means 330 to cause the compartments to fold suitably comprises means to control the path of the hinges 316, 318 and means to drive the hinges about that path. The means to control the path of the hinges controls, in particular, the relative positions of each hinge relative to the hinges immediately adjacent in the same track and also the respective hinge in the opposed track that forms the hinge pair. In the exemplary embodiments this is achieved by guiding every other hinge in each track along a different path to the intermediate hinges. Referring to FIG. 19, the hinges in the upper track follow either path 340 or path 342, whereas the hinges in the lower track follow either path 344 or path 346. Each of the paths for the upper track is twinned with one of the paths of the lower track. For instance, path 340 is twinned with path 344 (both shown dotted) and path 342 is twinned with path 346 (both shown solid). When moving from right to left on FIG. 19, path 340 moves towards path 344 (in order to close about the spring assembly). Path 340 and 344 then substantially follow each other before moving apart again at the left hand side (in order to release the spring unit once formed). Paths 342 and 346 are also brought together, before substantially following each other and then moving apart. Paths 340 and 344 come together at a position to one side of the spring's central axis whereas paths 342 and 346 come together at a position to the other side of the spring's central axis. The paths are arranged such that at least one of the hinges is caused to move toward the central axis. Thus the compartments are alternately folded left and right. Preferably, as shown in FIG. 19, the twinned paths cross each other. Here paths 340 and 346 change from a portion having a larger radius to a portion having a smaller radius and paths 342 and 344 change from a portion with a smaller radius to a portion with a larger radius. It will be appreciated that the locations at which each twinned paths meet and separate are off-set in a direction of movement of the spring assembly. This allows the alternate hinge pairs to be inserted from alternate sides.

Figure 20:
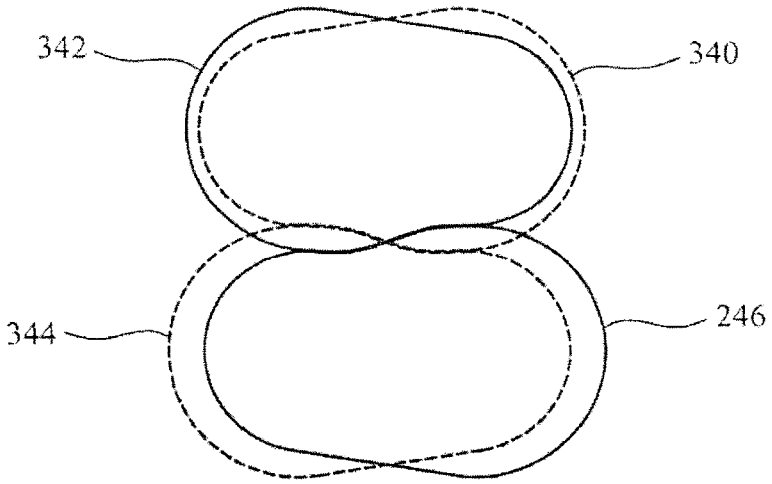

Preferably, in order to provide a continuous process, the upper and lower tracks are formed in a continuous belt. Thus, the paths 340, 342, 344 and 346 may form loops as shown in FIG. 20.

Figure 21:
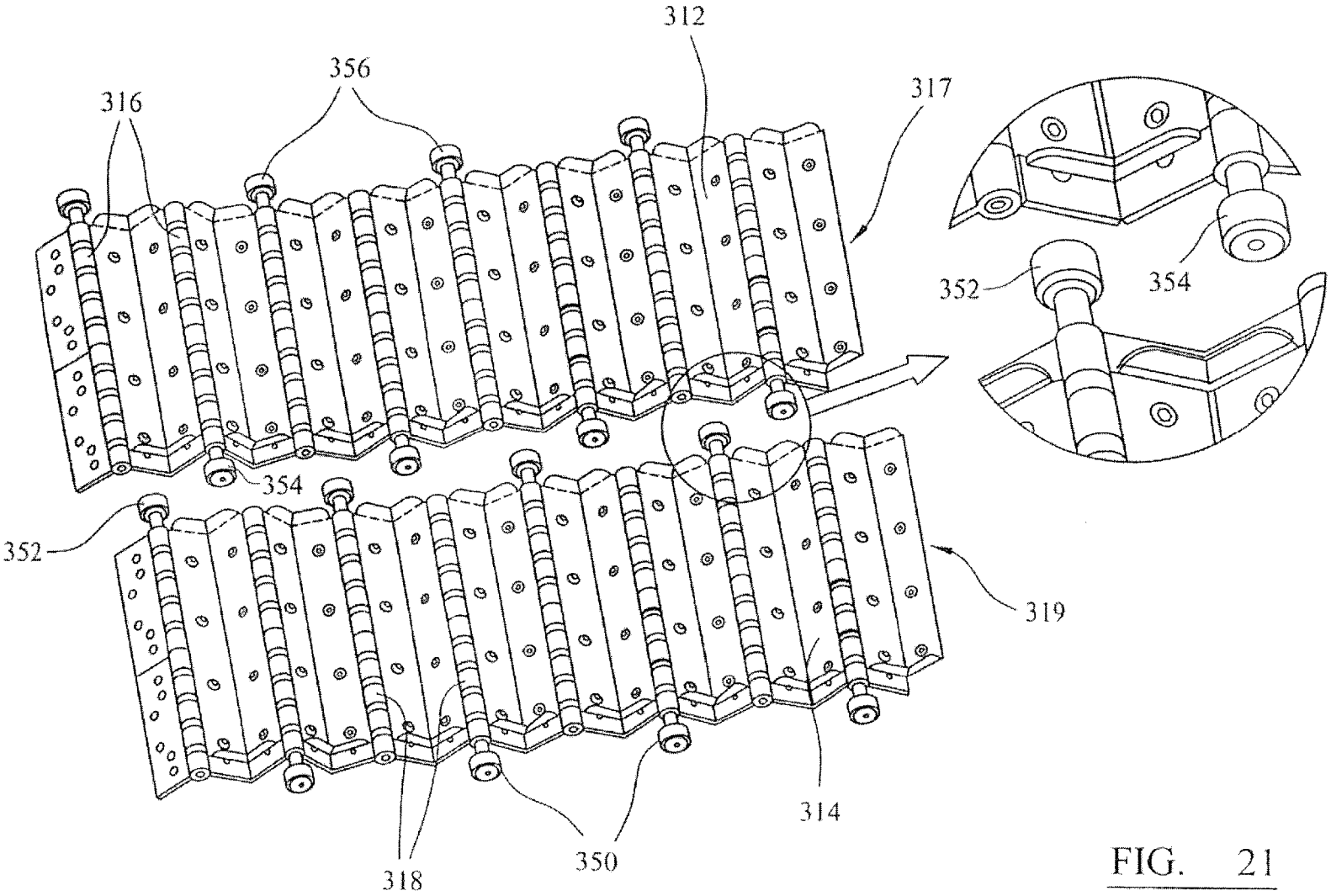
FIG. 21 is a pictorial view of belts for forming openable compartments of a folding station.

An exemplary embodiment of a portion of the upper and lower tracks is shown in FIG. 21. Here the opposed sections 312, 314 are formed from two links that are pivoted together. Each adjacent opposed section 312, 314 is pivoted to the other by respective hinges 316, 318. It will be appreciated that the tracks are continuous and that only a portion is shown in the Figures. Followers are arranged on each of the hinges. The followers arranged on adjacent hinges are arranged so as to follow alternate paths. Suitably, the followers are shown as being arranged on alternate sides of the hinges. Thus every other hinge on the lower track has a follower 350 on a distal end to one side of the track and the remaining hinges have followers 352 on a distal end to the other side. Likewise every other hinge of the upper track has followers 354 to one side and the remaining hinges, followers 356 to the other side. Each follower has a head and a shaft. The shaft extends coincident with the axis of the hinge.

Figure 22:
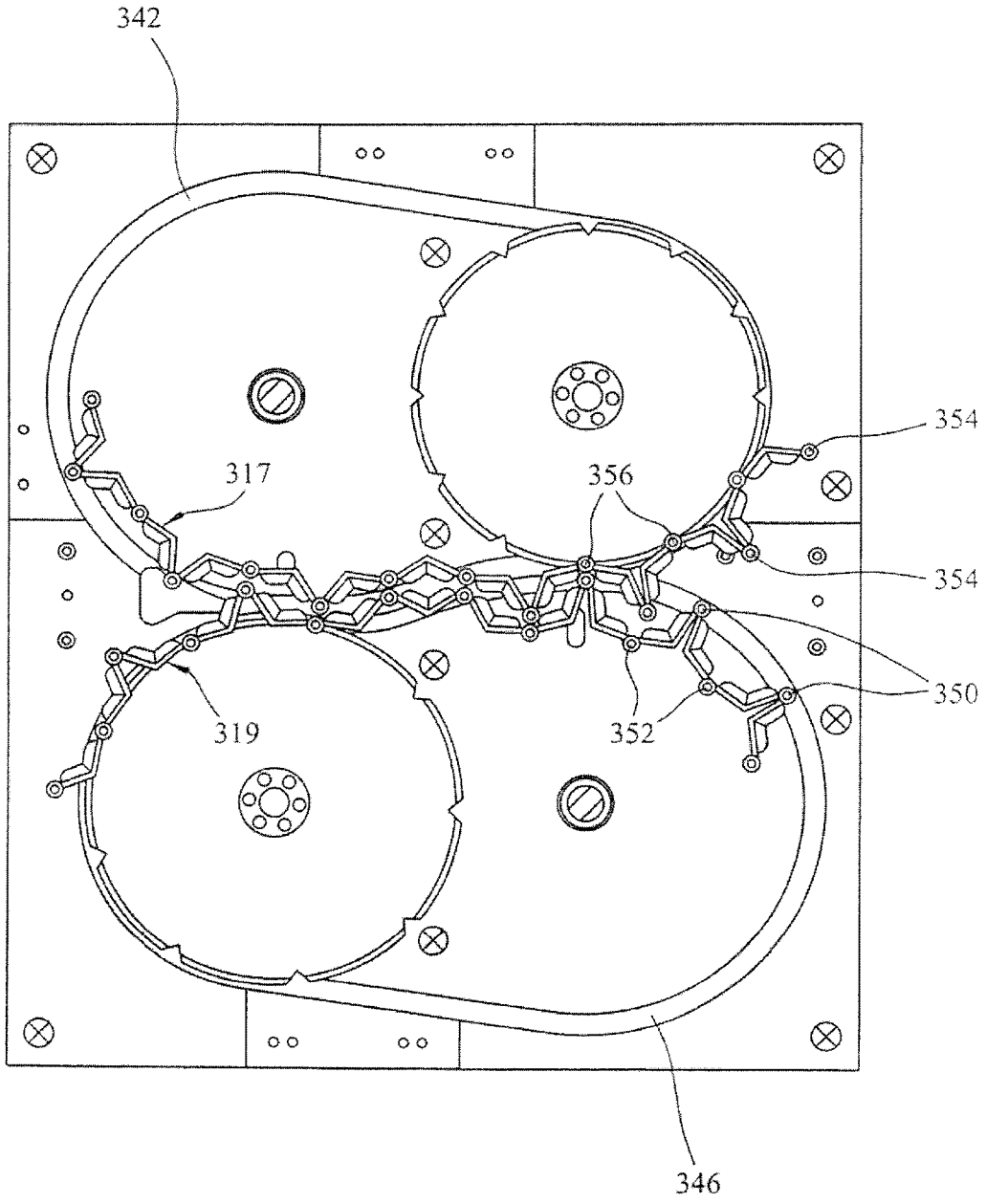
FIG. 22 is a cross-sectional side view through a folding station.

FIG. 22 shows the hinges of the portions of the upper and lower tracks following the paths. Here, the paths are defined by channels. Plates having the channels are arranged on either side of the tracks. Here, the channels defining the alternate paths for each upper or lower track are arranged on either side. Thus, the followers on one side engage the channel to that side but do not engage the channel on the other side and vice versa. The hinges are constrained to move in a parallel arrangement so that a hinge acts on all the springs in the spring assembly equally.

Figure 23:
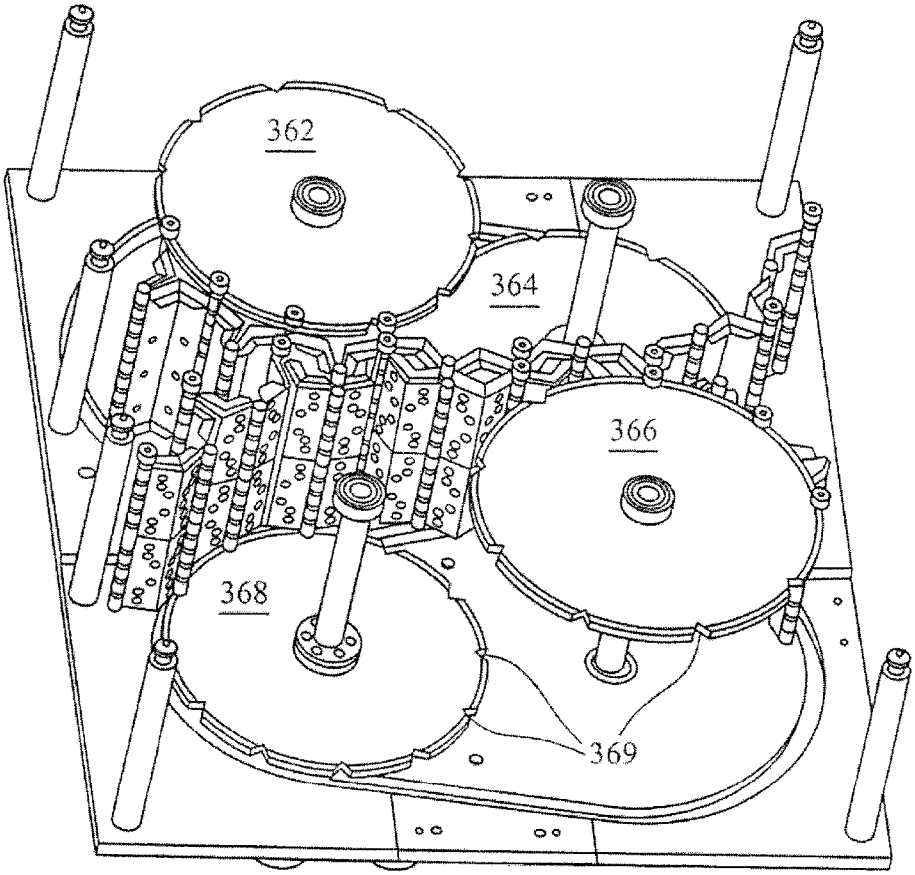
FIG. 23 is partially cut away view of a folding station.

It will be appreciated that once a front end of a spring assembly begins to be nipped by the rear of the first component, the spring unit is folded by moving the spring through the folding station. As mentioned, it is therefore preferable for the folding station to include means to move the hinges about the respective paths in order to drive the spring unit through the folding machine. Preferably, hinges in both the upper and lower tracks are drivers. A suitable means to drive the hinges is shown in FIG. 23. Here sprockets are arranged to contact the hinges as they move round a portion of their path that has the smaller radius. Thus, preferably, four sprockets 362, 364, 366 and 368 are provided. Each sprocket has a plurality of engagement means to engage the hinges. The engagement means are shown as notches 369. Suitably, the sprockets are arranged on alternate sides of the hinges. Thus, as shown, the notches are arranged to engage the shaft of each follower arranged on the same side.

In order to drive the hinges, at least one of the sprockets needs to be driven to rotate in any well known manner. However, as mentioned, it is preferable if at least one of the sprockets acting on each upper and lower track is driven. The two driven sprockets may be driven separately or in a linked manner. However, in order for the hinge parts to move substantially together once they have closed about the spring unit, it is important that the speed of each of the sprockets is controlled in order to move the hinges together. It will be appreciated that in order to form a production line, the movement of the spring unit through the folding station should preferably be matched to the movement of springs through the gathering station.

Figure 24:
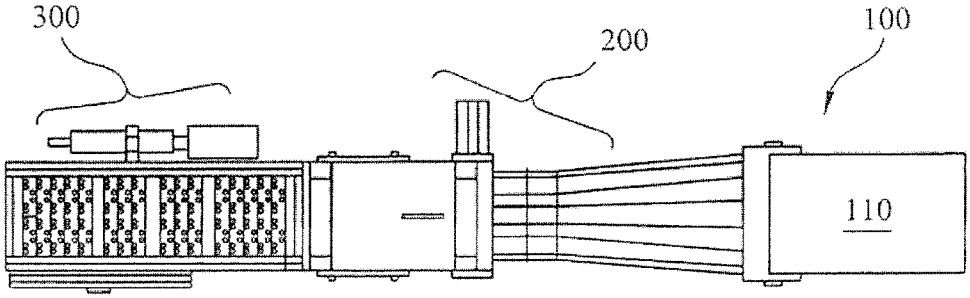
FIG. 24 is a side view of a forming apparatus.

The forming apparatus has been described in an upright arrangement wherein the springs are arranged horizontally. However, with reference to FIG. 24, it will be appreciated that it could equally be arranged with the springs vertically arranged.

Although preferred embodiment(s) of the present invention have been shown and described, it will be appreciated by those skilled in the art that changes may be made without departing from the scope of the invention as defined in the claims.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

The invention claimed is:

1. A method of forming a pocketed spring unit comprising a plurality of pocketed spring portions arranged in a row, the pocketed spring portions each comprising a portion of coil spring encased in a pocket, the axis of the portion of coil spring being substantially transverse to the row, wherein the method comprises the steps of: forming a continuous coil spring, encasing the spring in a pocket and deforming the encased spring to form the pocketed spring portions, wherein the step of deforming the encased spring comprises pressing the pocket between adjacent turns of the spring and then folding the spring within the pocket, to form the pocketed spring portions.

2. A method according to claim 1, wherein the method further includes the step of alternately folding the spring within the pocket in opposed directions, in the manner of a folded fan.

3. A method according to claim 2, wherein the method further includes the step of joining together adjacent pocketed spring portions to cause them to maintain their deformed configuration.

4. A method according to claim 1, wherein the method further includes the step of joining together adjacent pocketed spring portions to cause them to maintain their deformed configuration.

5. A method of forming a pocketed spring array, the method comprising taking a plurality of coil springs, encasing each spring within its own pocket, arranging the encased springs to be substantially parallel and joining the pockets of adjacent springs, then substantially simultaneously deforming the encased springs to form plural sets of pocketed spring portions.

6. A method according to claim 5, comprising pressing the pockets between adjacent turns of the springs and then folding the springs within the pockets, to form the pocketed spring portions.

7. A method according to claim 6, wherein the pressing of the pockets is effected by inserting a blade member between adjacent turns of several adjacent springs substantially simultaneously.

8. A pocketed spring unit comprising a substantially continuous coil encased in a substantially continuous pocket, and comprising a plurality of folds wherein the folds define a plurality of individual pocketed spring portions in a row, each of the individual pocketed spring portions comprising a spring portion having only one axis extending substantially transverse to the row and being encased in its own pocket portion.

9. A method of forming a pocketed spring unit comprising a plurality of pocketed spring portions arranged in a row, the pocketed spring portions each comprising a portion of coil spring encased in a pocket, the axis of the portion of coil spring being substantially transverse to the row, wherein the method comprises the steps of: forming a continuous coil spring, encasing the spring in a pocket and deforming the encased spring to form the pocketed spring portions, wherein the method further includes the step of alternately folding the spring within the pocket in opposed directions, in the manner of a folded fan.

10. A method according to claim 9, wherein the method further comprises the step of joining together adjacent pocketed spring portions to cause them to maintain their deformed configuration.

11. A method according to claim 9, wherein the step of deforming the spring comprises pressing the pocket between adjacent turns of the spring and then folding the spring within the pocket, to form the pocketed spring portions.

12. A method according to claim 11, wherein the method further comprises the step of joining together adjacent pocketed spring portions to cause them to maintain their deformed configuration.

13. A method according to claim 11, wherein the step of deforming the spring comprises pressing the pocket between adjacent turns of the spring and then folding the spring within the pocket, to form the pocketed spring portions.

14. A method according to claim 11, wherein the method further includes the step of alternately folding the spring within the pocket in opposed directions, in the manner of a folded fan.

15. A method of forming a pocketed spring unit comprising a plurality of pocketed spring portions arranged in a row, the pocketed spring portions each comprising a portion of coil spring encased in a pocket, the axis of the portion of coil spring being substantially transverse to the row, wherein the method comprises the steps of: forming a continuous coil spring, encasing the spring in a pocket and deforming the encased spring to form the pocketed spring portions, wherein the method further includes the step of joining together adjacent pocketed spring portions to cause them to maintain their deformed configuration.

* * * * *